US005282277A

United States Patent [19]

Onozawa

[11] Patent Number: 5,282,277

[45] Date of Patent: Feb. 1, 1994

[54] BODY COVER FOR OUTDOOR USE

[76] Inventor: Shoji Onozawa, 19152 SE. 151st St., Issaquah, Wash. 98027

[21] Appl. No.: 874,399

[22] Filed: Apr. 27, 1992

[51] Int. Cl.[5] ..... A41D 1/06

[52] U.S. Cl. ..... 2/69; 2/67; 2/115; 2/108; 2/79; 2/227; 2/228; 2/DIG. 4; 2/DIG. 1; 2/82; 2/46

[58] Field of Search ..... 2/69, 2.1 R, 67, 115, 2/108, 79, 227, 228, DIG. 4, DIG. 1, 82, 46; 450/97; 128/379; 604/312

[56] References Cited

U.S. PATENT DOCUMENTS

| | | | |
|---|---|---|---|
| 2,177,543 | 10/1939 | Vecchi | 2/46 |
| 4,276,341 | 6/1981 | Tanaka | 2/2.1 R |
| 4,494,246 | 1/1985 | Tillbrook | 2/2.1 R |
| 4,739,522 | 4/1988 | Lassiter et al. | 2/69 |
| 4,807,303 | 2/1989 | Mann et al. | 2/69 |
| 4,946,453 | 8/1990 | Monson | 2/2.1 R |
| 5,033,116 | 7/1991 | Hagaki et al. | 2/67 |

FOREIGN PATENT DOCUMENTS

| | | | |
|---|---|---|---|
| 2309115 | 4/1975 | France | 2/108 |
| 2498059 | 7/1982 | France | 2/79 |
| 9109544 | 7/1991 | PCT Int'l Appl. | 2/69 |

OTHER PUBLICATIONS

In-Sport Catalog, In-Sport, Spring, 1989.
Ultra-Sportswear Catalog, Ultra Sportswear, publication date unknown.
Bike Nashbar Catalog, Bike Nashbar, 1991.
Giordana Catalog, Giordana, 1989.
Bellwether Brochure, Bellwether, publication date unknown.
Aqua-No TMC Catalog, Bellwether, Fall, 1992.
Cycle Source Catalog, REI, 1990.
Performance Catalog, Performance Bicycle Shop, Autumn, 1990.
Performance Catalog, Performance Bicycle Shop, Fall, 1989.

*Primary Examiner*—Clifford D. Crowder
*Assistant Examiner*—Gloria Hale
*Attorney, Agent, or Firm*—Graybeal Jackson Haley & Johnson

[57] ABSTRACT

A body cover, or clothing, for athletes is disclosed. The body cover is comprised of a first material portion adapted to be placed over the anterior portion of the body of the athletes. The first material portion is comprised of a plurality of longitudinal, attached panels of "NEOPRENE" having a thickness of preferably from about 1 to 3 millimeters. The first material portion is waterproofed, provides insulation and wind protection, and is adapted to hold liquid against the anterior portion of the athlete's body such that the liquid absorbs body thermal energy. A second material portion adapted to be placed over the posterior portion of the body of the athlete is comprised of a plurality of longitudinal, attached panels of "LYCRA". The second material portion allows evaporation of liquid on the posterior portion of the body of the athlete and radiation of thermal energy therethrough. Third material portions attach the first material portion and the second material portion to form the body covering. The third material portion is comprised of an elastic substance.

17 Claims, 2 Drawing Sheets

FIG. 1
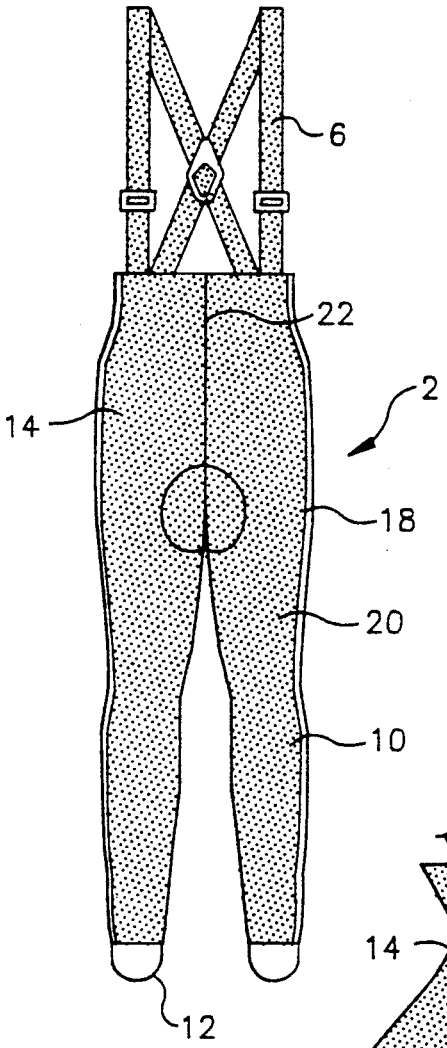
FIG. 2
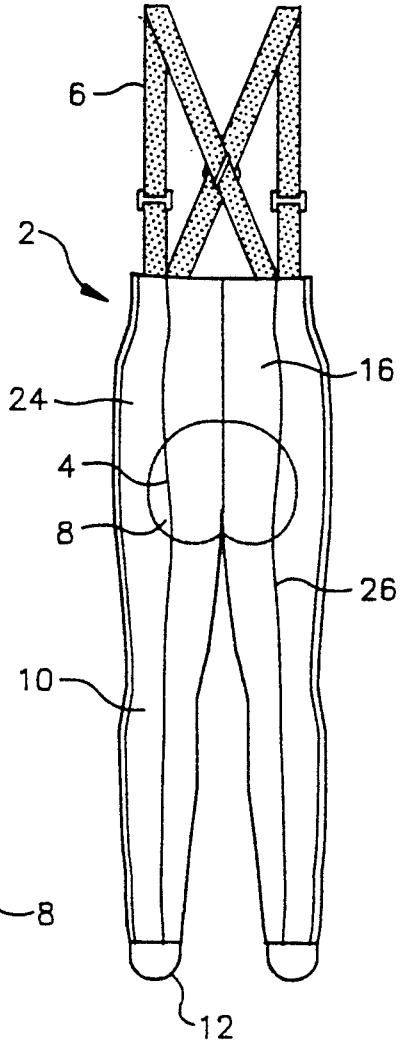
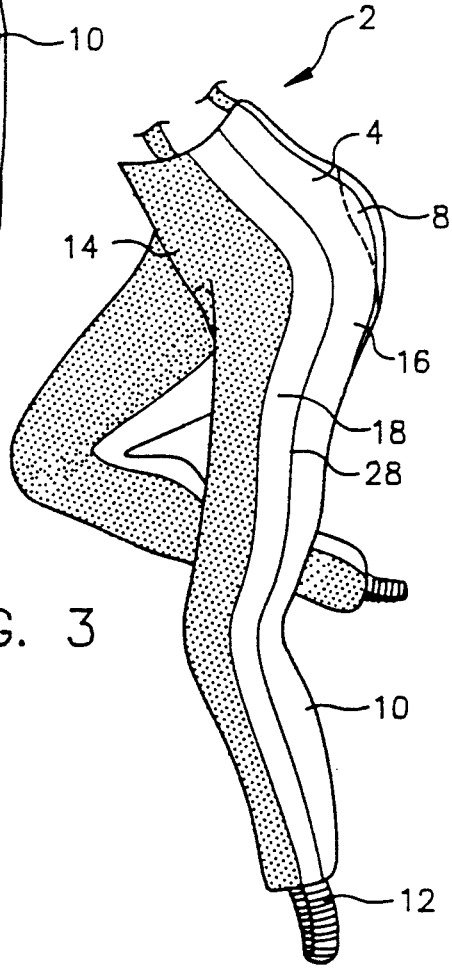
FIG. 3

BODY COVER FOR OUTDOOR USE

BACKGROUND OF THE INVENTION

The present invention pertains to body covering, or clothing, for outdoor use. More specifically, the present invention relates to body covering for use during athletic endeavors such as bicycling, motorcycling, running, roller skating, skate boarding, skiing, ice skating, or any other type of athletic activity in which winds are encountered or in which relative motion of the individual produces a wind chill factor.

Conventional clothing for sports activities described above are generally comprised of "LYCRA" or cotton fabric in order for perspiration to be able to evaporate and for thermal body energy to be able to radiate therethrough. However, this "LYCRA" or cotton clothing provides no protection from wind, or wind chill caused by relative movement of the athlete, and the wearer thus is subject to hypothermia due to loss of body heat. Additionally, this "LYCRA" or cotton clothing absorbs moisture such as sweat and/or perspiration, thus exacerbating the loss of body heat which results in hyperthermia. In order to circumvent the above short comings of the "LYCRA" or cotton clothing, clothing comprised of "NEOPRENE" has been employed. While "NEOPRENE" does act as a wind breaker, is waterproof, and provides insulation, "NEOPRENE" of traditional thickness restricts bodily movement and, due to its lack of porosity, causes body overheating because sweat and body thermal energy cannot escape therethrough.

A need thus exists for body cover, or clothing, for use during outside athletic activities where wind, or wind chill caused by relative body movement, or moisture is encountered; said body cover being waterproof, insulating, providing wind protection, and allowing evaporation of liquid from the human body and radiation of body thermal energy therethrough.

SUMMARY OF THE INVENTION

In accordance with the invention, a body covering for outdoor athletics is provided. The body covering includes a first material portion adapted to be placed over the anterior portion of the body of the athlete. The first material portion is comprised of a waterproof, insulating substance providing wind protection, and is adapted to hold liquid against the anterior portion of the body of the athlete such that the liquid retains thermal energy. A second material portion adapted to be placed over the posterior portion of the body of the athlete is attached to the first material portion to form the body cover. The second material portion is comprised of a semi-porous substance allowing evaporation of liquid on the posterior portion of the body of the athlete and radiation of body thermal energy therethrough.

Third material portions are optionally located between the first material portion and the second material portion to join the first material portion and second material portion. The third material portion is preferably comprised of an elastic substance. The first material portion is preferably comprised of two longitudinal, attached panels. However, more or less than two longitudinal, attached panels can be employed. Similarly, the second material portion is preferably comprised of six longitudinal, attached panels. However, more or less than six longitudinal, attached panels can be used.

The first material portion and the second material can be configured to form pants having a seat portion and two leg portions, or a shirt having a body portion and two arm portions.

The first body portion is preferably comprised of "NEOPRENE" or a "LYCRA"-"NEOPRENE" laminate of a thickness of preferably from about 1 to 3 millimeters. However, the first material portion may be comprised of other substances which waterproof, insulate, provide wind protection, and retain liquid against the body such that the liquid absorbs body thermal energy.

The second material portion is preferably comprised of "LYCRA", however, other substances which allow evaporation of liquid from the human body and radiation of body thermal energy therethrough may also be employed.

BRIEF DESCRIPTION OF THE DRAWINGS

The foregoing objects and attendant advantages of this invention will become more readily appreciated as the same becomes better understood by reference to the following detailed description when taken in conjunction with the accompanying drawings wherein:

FIG. 1 is a front view of a first embodiment of the body cover of the present invention;

FIG. 2 is a rear view of a first embodiment of the body cover of the present invention;

FIG. 3 is a side view of a first embodiment of the body cover of the present invention;

DETAILED DESCRIPTION OF THE PREFERRED EMBODIMENTS

Figure 4:
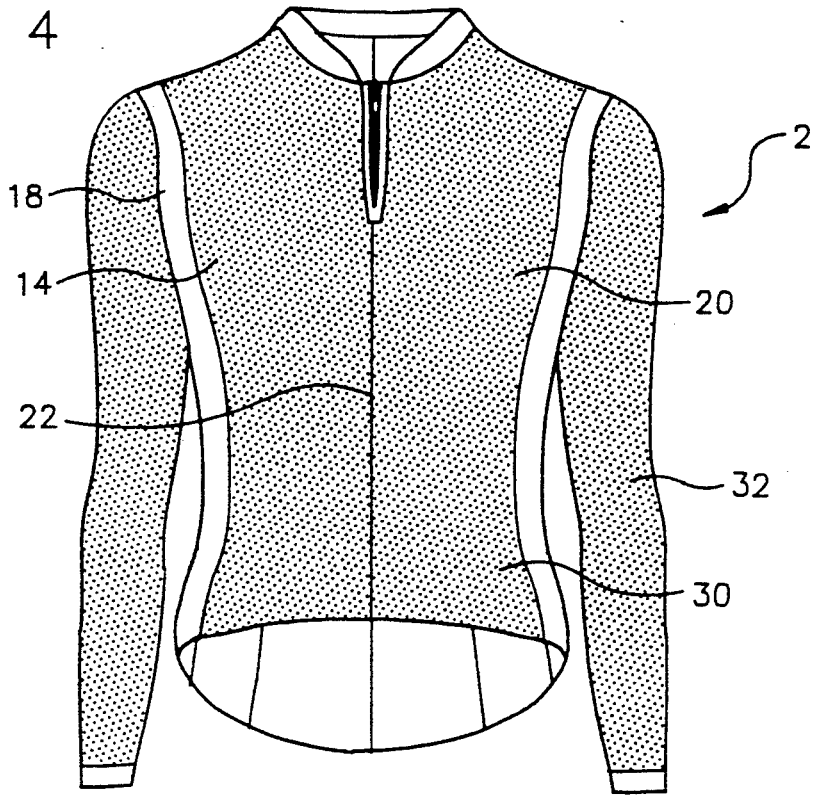
FIG. 4 is a front view of a second embodiment of the body cover of the present invention.

Referring to FIGS. 1 through 3 of the first embodiment of the present invention is shown. Body cover 2, shown in the first embodiment of the present invention as pants, is intended to encompass any type of clothing or garment including, but not limited to, pants, shirts, coats, jumpsuits, and/or overalls. In the first embodiment of the present invention body cover 2 are pants which include seat portion 4 having suspenders 6 and padding 8, and leg portions 10 having stirrups 12. Body cover 2 is divided into anterior area 14, posterior area 16 and lateral area 18. An essential aspect of the present invention is the material composition of anterior area 14 and posterior area 16 of body cover 2. Most preferably, the material employed for anterior area 14, posterior area 16 and lateral area 18 have elastic properties which allow body cover 2 to be relatively tight fitting to allow free bodily movement.

Describing anterior area 14 in more detail, anterior area 14 is comprised of a material which is waterproof, insulates, provides wind protection and is adapted to hold liquid against the anterior portion of the human body such that the liquid absorbs body thermal energy. Preferably, 2-chloro-1,3-butadiene (sold under the trade name "NEOPRENE") is used. However, a laminate of "NEOPRENE" on polyurethane polymer fibers (sold under the trade name "LYCRA"), natural or synthetic rubber with opened or closed air cells, or a foamed synthetic polymer having opened or closed air cells can be employed. The material employed for anterior area 14 is preferably from about 1 to 3 millimeters in thickness, however, thicknesses from between about 0.5 millimeters to 6 millimeters can be employed. Two longitudinal panels of "NEOPRENE" or the like secured by stitching 22 preferably comprise anterior area 14. However, more or less than two panels 20 can be employed.

Now describing in detail posterior portion 16, posterior portion 16 is comprised of a semi-porous material allowing evaporation of liquid from the human body and radiation of body thermal energy therethrough. Preferably, posterior portion 16 is comprised of polyurethane polymer fibers (sold under the trade name "LYCRA"). However, posterior portion 16 can also be comprised of wool; silk; 1,6-hexanediamine hexanedioc acid (sold under the trade name "NYLON"); polymerized acrylonitrile, (sold under the trade name "ACRYLIC"); or polyethyleneglycol terephthalate (sold under the trade name "DACRON"). Preferably four longitudinal panels 24 of "LYCRA" or the like, secured by stitching 26 are employed to form posterior portion 16. However, more or less then four panels 24 can be employed.

Lateral area 18 is an area which may optionally be comprised of material different than either of the materials employed for anterior portion 14 or posterior portion 16 as long as lateral portion 14 has elastic qualities. It should be noted that lateral area 18 can instead be comprised of the same material employed for either anterior portion 14 or posterior portion 16. Preferably, two lateral areas 18 are present, one each secured between anterior area 14 and posterior 16 on opposite sides of body cove 2 with stitching 28.

Figure 5:
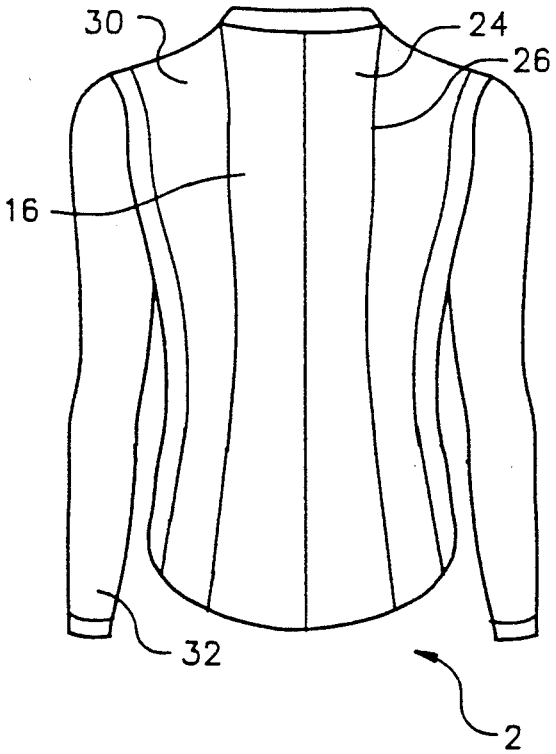
FIG. 5 is a back view of a second embodiment of the body cover of the present invention.
Figure 6:
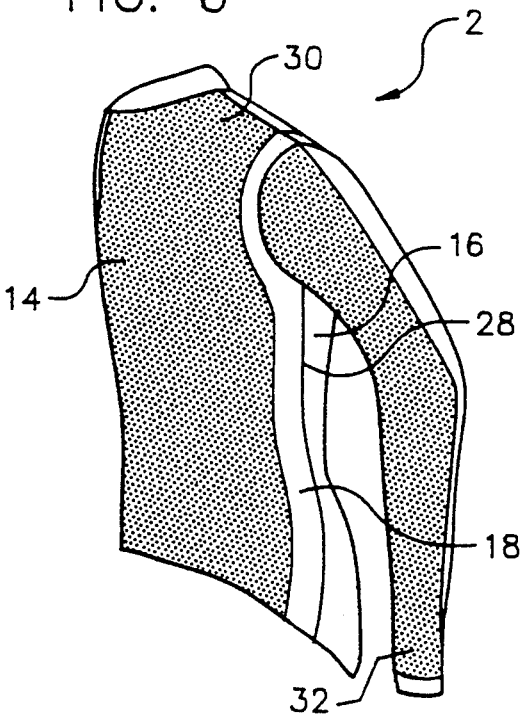
FIG. 6 is a side view of a second embodiment of the body cover of the present invention.

Now referring to the second embodiment of the present invention is shown in FIGS. 4, 5, and 6, body cover 2 is a shirt having body portion 30 and arm portions 32. Aside from the difference in physical configuration of the pants body cover 2 of the first embodiment and the shirt body cover 2 of the second embodiment of the present invention, these two embodiments share common elements denoted by like element numbers and also share common material composition. Thus, in both the first and second embodiment of the present invention anterior portion 14 of body cover 2 waterproofs, insulates, and wind protects the anterior portion of the body of the athlete while holding sweat and other moisture against the anterior portion of the human body such that this liquid absorbs body thermal energy. Furthermore, the posterior portion of body cover 2 allows evaporation of sweat and other liquid from the posterior portion of the body of the athlete and also allows radiation of body thermal energy therethrough. In this manner, the lowering of body temperature due to wind chill and the accompanying risk of hypothermia are avoided because the anterior portion of the athlete's body is shielded from wind, or wind chill due to relative body motion, and from moisture due to the material comprising the anterior portion 14 area of body cover 2. Additionally, body overheating is avoided because of the sweat evaporation and thermal energy radiation from the posterior portion of the athlete's body through the material comprising the posterior area of body cover 2.

While preferred embodiments of the invention have been illustrated and described, it will be appreciated that various changes can be made therein without departing from the spirit and scope of the invention.

I claim:

1. A body cover comprising:

a first material portion adapted to be placed only over the anterior portion of a human body, said first material portion comprised of a waterproof, insulating substance providing wind protection and adapted to hold liquid against the anterior portion of the human body such that the liquid retains body thermal energy; and a second material adapted to be placed only over the posterior portion of a human body, said second material portion attached to said first material portion by a third portion to form said body cover, said second material portion comprised of a semi-porous substance allowing evaporation of liquid on the posterior portion of the human body and radiation of body thermal energy therethrough.

2. The body cover of claim 1 wherein said first material portion is comprised of two longitudinal, attached panels.

3. The body cover of claim 1 wherein said second material portion is comprised of six longitudinal, attached panels.

4. The body cover of claim 1 wherein said first material portion and said second material portion form pants having a seat portion and two leg portions.

5. The body cover of claim 1 wherein said first material portion and said second material portion form a shirt having a body portion and two arm portions.

6. The body cover of claim 1 wherein said first material portion is selected from the group consisting of 2-chloro-1,3-butadiene, natural rubber, synthetic rubber and a foamed polymer.

7. The body cover of claim 1 wherein said first material portion is comprised of 2-chloro-1,3-butadiene.

8. The body cover of claim 1 wherein said first material portion is a 2-chloro-1,3-butadiene and polyurethane polymer laminate.

9. The body covering of claim 1 wherein said first material portion has a thickness from about 1 to 3 millimeters.

10. The body cover of claim 1 wherein said second material portion is selected from the group consisting of polyurethane, wool, silk, 1,6-hexanediamine hexanedioc acid, polymerized acrylonitrile and polyethyleneglycol terephthalate.

11. The body cover of claim 10 wherein said second material portion is polyurethane.

12. A body cover for a bicyclist comprising:

a first material portion adapted to be placed over the anterior portion of the body of the athlete, said first material portion comprised of a plurality of longitudinal, attached panels of 2-chloro-1,3-butadiene having a thickness from about 1 to 3 millimeters, said first material portion being waterproof, providing insulation and wind protection, and adapted to hold liquid against the anterior portion of the body of the athlete such that the liquid retains body thermal energy;

a second material portion adapted to be placed over the posterior portion of the body of the athlete, said second material portion comprised of a plurality of longitudinal, attached panels of polyurethane, said second material portion allowing evaporation of liquid on the posterior portion of the body of the athlete and radiation of body thermal energy therethrough; and third material portions attaching said first material portion and said second material portion to form said body covering, said third material portion comprised of an elastic substance.

13. The body covering of claim 12 wherein said plurality of panels of said first material portion are two in number.

14. The body covering of claim 12 wherein said plurality of panels of said second material portion are six in number.

15. The body cover of claim 12 wherein said 2-chloro-1,3-butadiene of said first material portion is laminated onto polyurethane.

16. The body cover of claim 12 wherein said first material portion, said second material portion and said third material portion form pants having a seat portion and two leg portions.

17. The body cover of claim 12 wherein said first material portion, said second material portion, and said third material portion form a shirt having a body portion and two arm portions.

* * * * *